US006553733B1

(12) United States Patent
Hock et al.

(10) Patent No.: US 6,553,733 B1
(45) Date of Patent: Apr. 29, 2003

(54) GLASS BLOCK WITH INTERNAL CAPSULE

(75) Inventors: Donald E. Hock, Olean, NY (US); John T. Verch, Coldwater, MI (US)

(73) Assignee: Pittsburgh Corning Corporation, Pittsburgh, PA (US)

( * ) Notice: Subject to any disclaimer, the term of this patent is extended or adjusted under 35 U.S.C. 154(b) by 0 days.

(21) Appl. No.: 09/437,165

(22) Filed: Nov. 10, 1999

(51) Int. Cl.[7] ..... E04C 1/00

(52) U.S. Cl. ..... 52/306; 52/307; 52/308; 52/200; 52/500; 52/590; 52/590.2; 52/591.1; 52/592.1; 52/592.6; 52/775

(58) Field of Search ..... 52/306, 307, 200, 52/591.1, 592.1, 580, 590.2, 592.6, 308, 590, 775

(56) References Cited

U.S. PATENT DOCUMENTS

| | | | | | |
|---|---|---|---|---|---|
| 2,118,643 | A | * | 5/1938 | Fox | 52/307 |
| 2,167,764 | A | * | 8/1939 | Lytle | 72/41 |
| 2,221,649 | A | * | 11/1940 | Mulford | 52/307 |
| 2,542,581 | A | | 2/1951 | Schreffler | |
| 3,127,926 | A | | 4/1964 | Adelt | |
| 3,160,925 | A | | 12/1964 | Gort | |
| 4,516,369 | A | * | 5/1985 | Olesen | 52/306 |
| 4,614,071 | A | * | 9/1986 | Sams | 52/309.12 |
| 4,628,652 | A | * | 12/1986 | Wefels | 52/223.7 |
| 5,038,542 | A | * | 8/1991 | Kline | 40/545 |
| 5,160,566 | A | | 11/1992 | Ashby et al. | |
| 5,333,427 | A | | 8/1994 | Uhlik | |
| 5,367,846 | A | * | 11/1994 | VonRoenn, Jr. | 52/308 |
| 5,448,864 | A | | 9/1995 | Rosamond | |
| 5,588,271 | A | * | 12/1996 | Pitchford | 52/306 |
| 5,595,033 | A | * | 1/1997 | Frey | 52/306 |
| 5,778,620 | A | * | 7/1998 | Fisher | 52/306 |
| 5,836,125 | A | * | 11/1998 | Regina | 52/306 |
| 5,890,335 | A | | 4/1999 | Fox | |
| 5,985,445 | A | * | 11/1999 | Stasi | 52/307 |
| 6,260,317 | B1 | * | 7/2001 | Fisher | 52/306 |

FOREIGN PATENT DOCUMENTS

| | | | | |
|---|---|---|---|---|
| DE | 1025601 | | 3/1958 | |
| FR | 848.079 | * | 10/1939 | 52/306 |
| FR | 1301654 | * | 7/1962 | 52/306 |

* cited by examiner

*Primary Examiner*—Carl D. Friedman
*Assistant Examiner*—Christy M. Green
(74) *Attorney, Agent, or Firm*—Reed Smith LLP

(57) ABSTRACT

Blocks with internal capsules having superior thermal resistance, solar control qualities, projectile-resistant properties and/or sound-dampening properties are described. The blocks are comprised of a structural exterior that encompasses a capsule. The capsule may be segmented into chambers with dividers. The capsules may be designed to provide various benefits including, but not limited to, improved insulating characteristics, increased projectile resistance, and/or a range of visual, thermal and strength characteristics. Various types of blocks with internal capsules and assembled panels of block with internal capsules are disclosed, along with methods of manufacturing and use of the blocks and panels.

11 Claims, 9 Drawing Sheets

GLASS BLOCK WITH INTERNAL CAPSULE

BACKGROUND OF THE INVENTION

1. Field of Invention

The present invention is directed generally to building materials and more specifically to blocks with an internal transparent or translucent capsule providing improved thermal resistance, solar control qualities, projectile-resistant properties and/or sound-dampening properties.

2. Description of the Related Art

Glass blocks and panels of glass blocks have been used in both residential and commercial building applications for many years. The popularity of glass block panels can be attributed to their various desirable features, including light transmittance, security, and their decorative aspects.

Prior attempts have been made to improve the insulating properties of glass block panels. For example, U.S. Pat. No. 2,167,764 to Lytle, incorporated herein by reference, illustrates a glass block with its interior space divided into compartments (see FIG. 1 of Lytle). Increasing the number of interior compartments, however, increases the number of the penetrations of the sidewall of the block (see FIG. 2 of Lytle). This complicates block manufacturing and increases the chance of seal failure. It would be desirable to improve insulating properties of blocks without increasing the number of sidewall penetrations.

Additional advantages may be gained by using a sheet within a glass block that is protected from dust, fingerprints, scratches and smudges. The sheet (or sheets) may be treated with low emissivity coatings, or other beneficial treatments. It would therefore be desirable to protect such a sheet prior to and during the manufacturing process to guard against physical damage or contamination.

IT would appear that assembly of a block with a sheet divider as described in Lytle would require external jigs or other devices to maintain proper alignment of the block portions during assembly. It would therefore be desirable to provide simpler means for aligning the block portions. Furthermore, it would be preferable to include means for proper placement of adhesive/sealant thereby facilitating assembly of blocks with an internal capsule, and reducing the chance of a seal failure.

In many instances, conventional glass block can not meet the projectile penetration standards required in hurricane-prone areas of the country. It would therefore be desirable to provide an improved projectile-resistant block without negatively affecting the aesthetic aspects of conventional glass block.

SUMMARY OF THE INVENTION

The present invention relates to a building material, and more specifically a glass block with an internal capsule, which provides improved thermal-resistance, solar control qualities, projectile-resistant properties and/or sound-dampening properties. The present invention also provides methods of assembly, manufacture, and use of blocks with internal capsules.

A glass block with the internal capsule of the present invention may provide some or all of the following advantages: (1) improved insulation properties due to the spaces, chambers and cavities formed within the blocks; (2) reduced thermal conductance due to a thermal break between the exterior faces and the interior faces of the blocks and in the mortar joints of panels constructed with the blocks; (3) improved solar control by using performance-enhancing coatings on one or more surfaces of or within the capsule; (4) improved aesthetics by employing color and design features on one or more surfaces of or within the capsule; (5) increased resistance to projectile penetration due to the presence of the capsule within the block; (6) improved sound-dampening properties; (7) increased strength and impact resistance of the blocks due to heat-strengthening (tempering) made possible by the manufacturing method; (8) a moisture barrier and an internal drainage channel in an assembled panel to prevent moisture penetrating from the exterior to the interior of the panel; (9) positioning means to facilitate alignment of block portions during assembly around the internal capsule; (10) a sealant-receptive area (e.g., a channel, ledge, base, corner, seam, etc.) to facilitate proper placement of the adhesive/sealant during assembly of the block portions; and (11) improved panel assembly through interlocking fittings that serve to connect, align, stabilize and/or space adjacent blocks.

The block is generally square or rectangular in shape and has a structural exterior that may be made of glass or other appropriate structural material (e.g., plastic, ceramic, or masonry). The block typically is comprised of two substantially identical portions that enclose a capsule.

The capsule generally comprises an exterior shell with an interior chamber. The chamber may be subdivided into two or more cavities by a divider, or a plurality of dividers. Dividers can be formed from any material that provides the requisite properties. For example, dividers may be comprised of a film that may be treated with a low emissivity coating to reflect heat, or the divider may be-comprised of an impact resistant material such as Lexane®. The chambers and cavities within the capsule and the spaces between the exterior shell and the block portions, may contain gas, gel, liquid or solid matter, under either positive or negative pressure, or at atmospheric pressure.

A block panel or wall incorporating one or more of the above types of block with internal capsules is also described, along with methods of assembling the block with internal capsules and constructing block panels.

BRIEF DESCRIPTION OF THE DRAWINGS

The features, aspects, and advantages of the present invention will become better understood with regard to the following description, appended claims, and accompanying drawings where:

DESCRIPTION OF THE PREFERRED EMBODIMENTS

Figure 1:
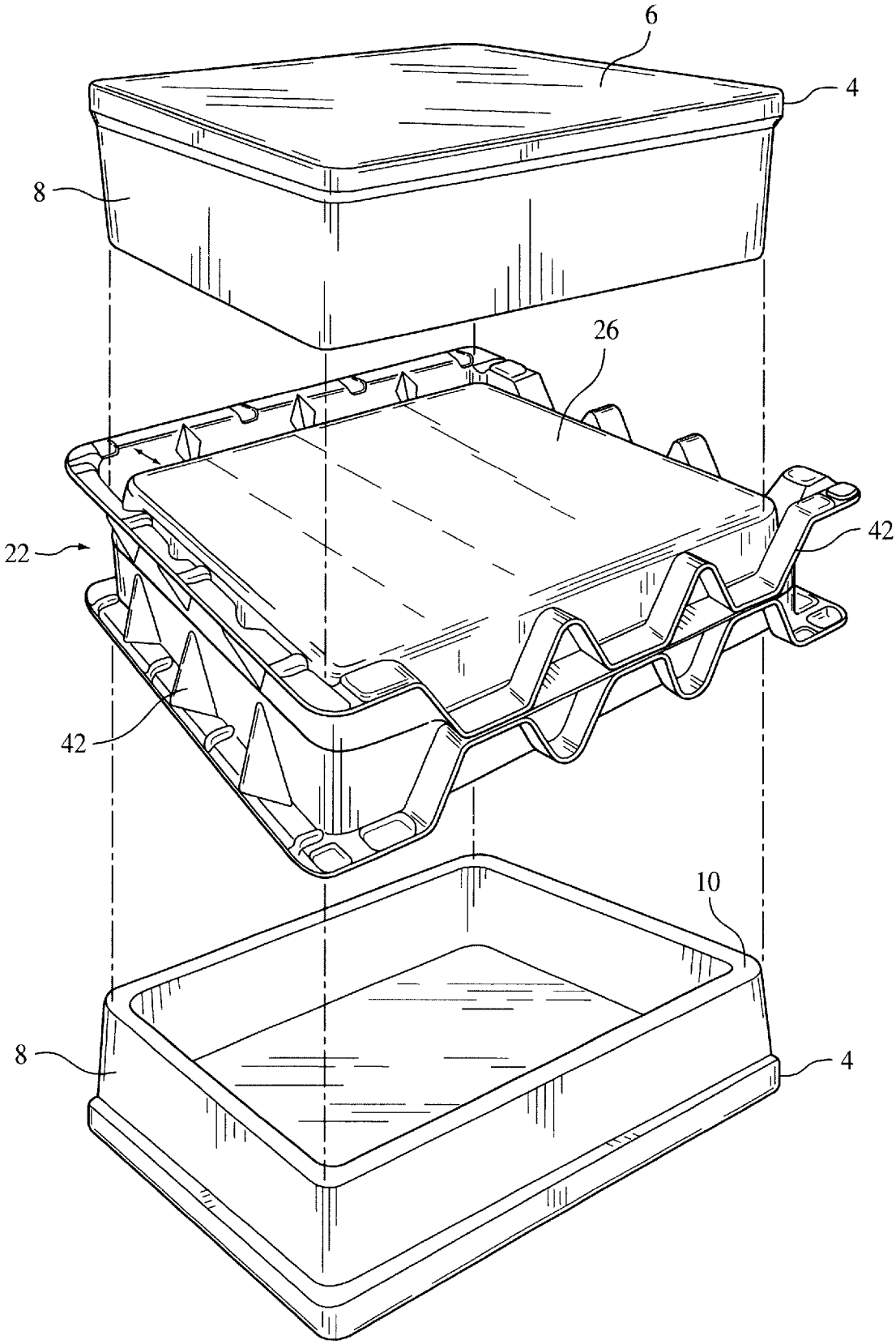
FIG. 1 is an exploded perspective view of one embodiment showing the relationship between a capsule and the block portions.

With reference to FIG. 1, an exploded perspective view of a capsule 22 and block portions 4 is shown. The capsule 22 is shown with an exterior shell 26 and fittings 42 for contacting fittings of blocks similarly composed. The block portions 4 have a face 6, a sidewall 8 and a rim 10 which can be coupled to contain a capsule 22 and form a block. The present invention allows heat tempering or other treatment of the block portions 4, prior to assembly. Conventional glass block manufacturing procedures preclude tempering of glass blocks because they are heat sealed during manufacture. Once the blocks are sealed, exposure to tempering heat causes the air in the interior compartment of the block to expand resulting in an undesirable convex surface on the face of the block. In the present invention, the block portions 4 can be tempered prior to assembly thereby increasing both their tensile strength and resistance to projectile penetration.

Figure 2:
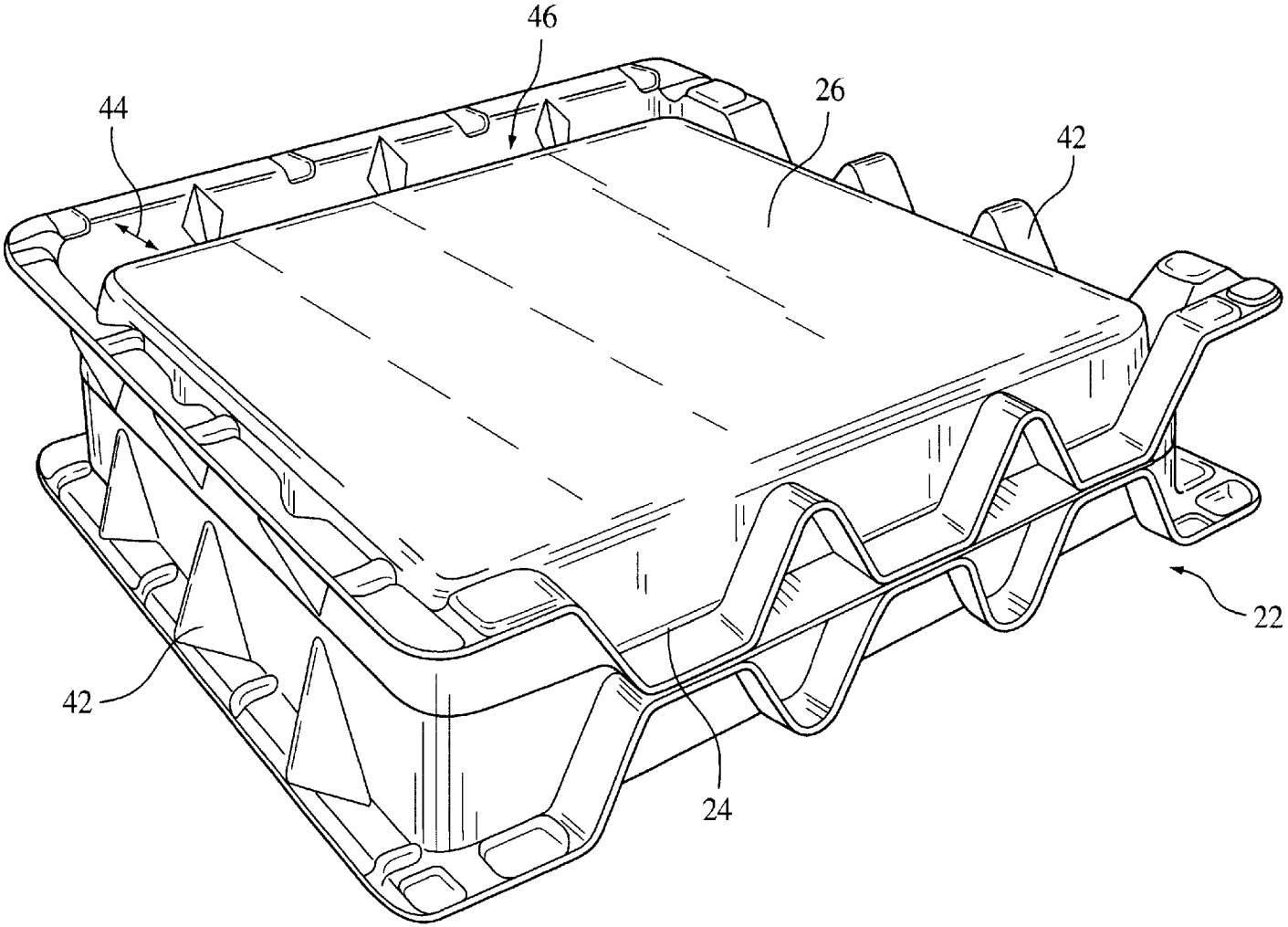
FIG. 2 is a perspective view of one embodiment of a capsule showing flanges with fittings that can interconnect with similar fittings of other capsules, frames or borders.

With reference to FIG. 2, one embodiment of a capsule 22 is shown with fittings 42 extending from the peripheral flange 24. This embodiment of an internal capsule 22 provides block alignment means 44 to facilitate placement of the block portions 4 upon assembly. One method of assembling a block with an internal capsule 22 is to place an adhesive/sealant in one block receiving channel 46 of the capsule, insert the block portion 4 into the channel 46 in contact with the adhesive/sealant. Repeat the process on the opposite aspect of the capsule 22 with the other block portion 4. The two block portions 4 may be pressed together, with the capsule 22 inside and the capsule flange 24 between them, until the adhesive/sealant cures.

It is contemplated that the present invention will incorporate adhesive/sealants that operate over a wide range of temperatures in a variety of environments. For example, cold seal acrylic sealants, epoxy sealants, temperature cured sealants or ultraviolet cured sealants may be used as appropriate. In preferred embodiments, ultraviolet-cured acrylic sealants such as Dymax® are used.

Figure 3A:
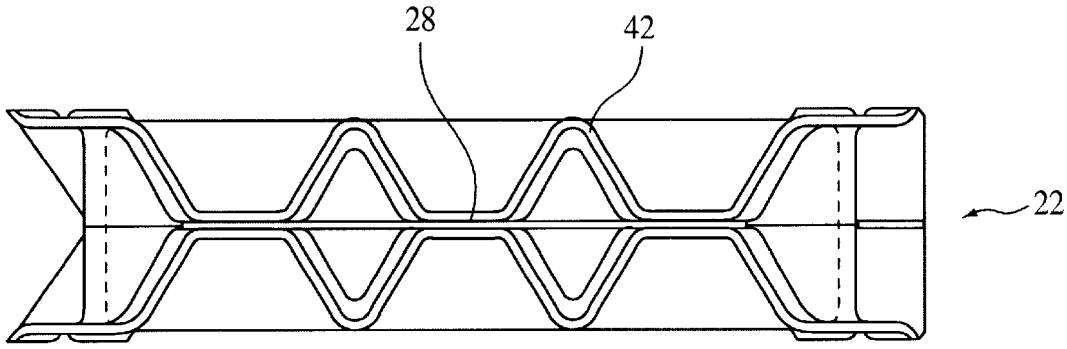
FIG. 3A is a side view of one embodiment of a capsule showing flanges with male fittings that interconnect with female fittings of other capsules.
Figure 3B:
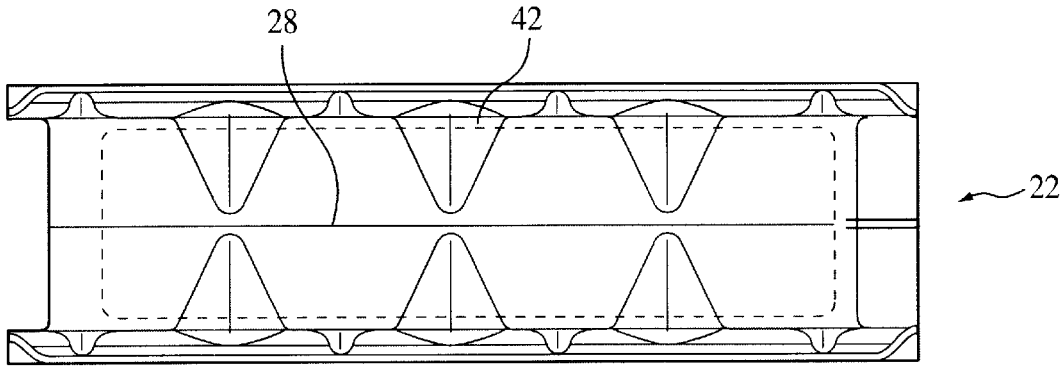
FIG. 3B is a side view of one embodiment of a capsule showing flanges with female fittings that interconnect with male fittings of other capsules.

Additional detail of an interconnected configuration (i.e., male/female scheme) of the fittings 42 is shown in FIG. 3. In this side view perspective of an internal capsule 22, medial placement of a divider 28 is shown in relation to the general configuration of the capsule 22.

Figure 4A:
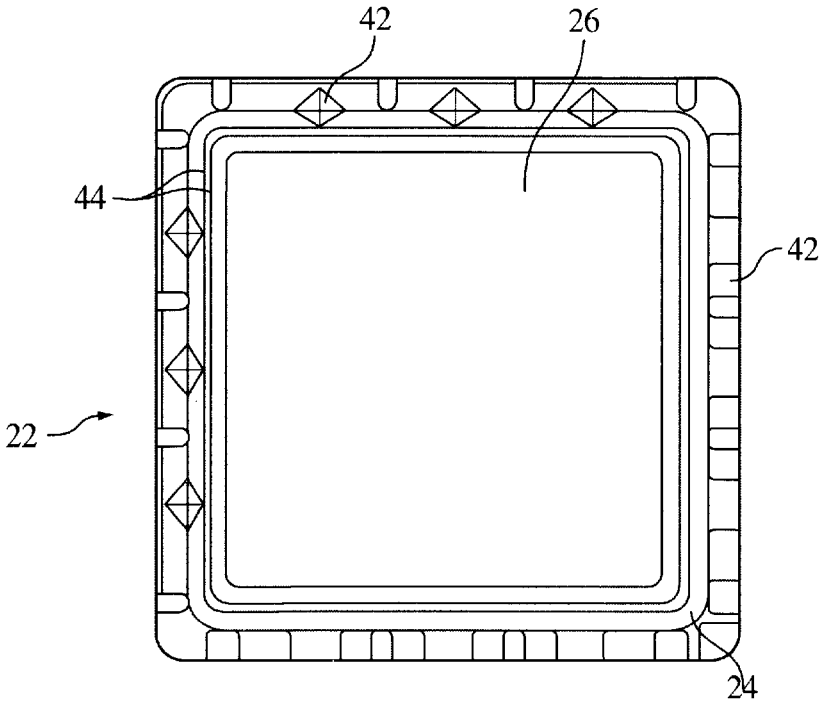
FIG. 4A is a top view of one embodiment of a capsule having a perimeter flange and a fitting extending from the flange.
Figure 4B:
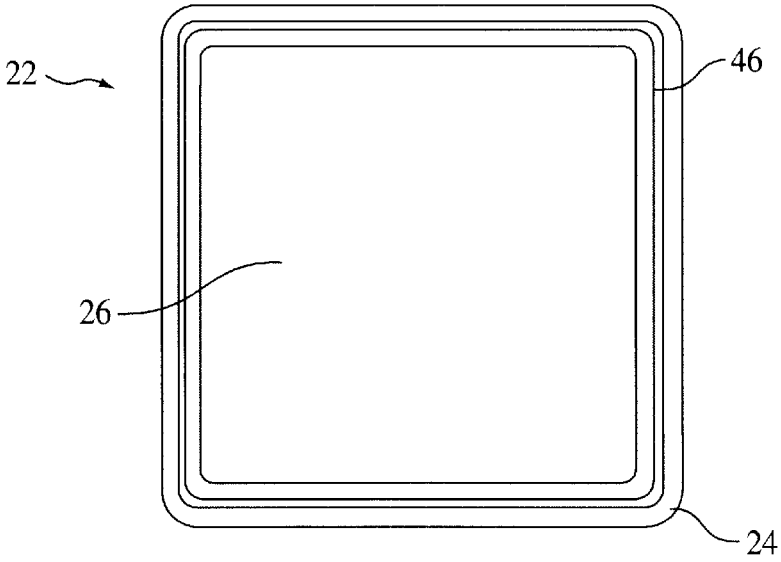
FIG. 4B is a top view of one embodiment of a capsule having a perimeter flange.

Alternate configurations of an internal capsule 22 are shown in FIG. 4. The top view of an internal capsule 22 shown in FIG. 4A depicts an embodiment with a shell 26 having a flange 24 extending from the shell 26 and a peripheral fitting 42 extending from the flange 24. This particular configuration forms a block alignment means 44 which is comprised of a channel bounded by the exterior periphery of the shell 26 and the interior periphery of the fittings 42. These block alignment means 44 facilitate the placement of the block portions 4 during assembly. In top view FIG. 4B an internal capsule 22 is shown without fittings 42. This embodiment of internal capsule 22 is comprised of a shell 26, a peripheral flange 24 extending from the shell 26 and a channel 46 or ledge, which is created at the point of the flange 24 attachment to the shell 26.

Figure 5A:
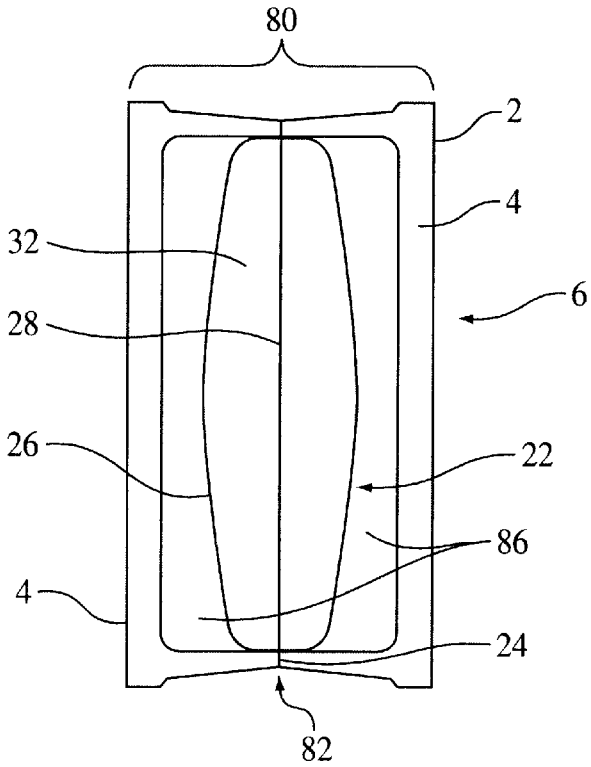
FIG. 5A is a cross-section schematic diagram of a block with an internal capsule having a flange fitted at the seam that secures the capsule substantially within the block.
Figure 5B:
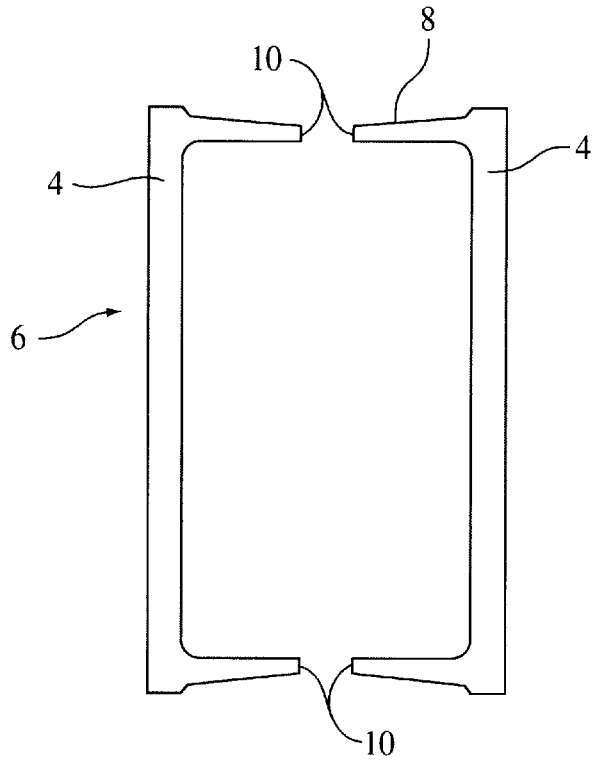
FIG. 5B is a cross-section schematic diagram of a pair of block portions, which may be sealed to form a glass block.

A schematic drawing of a block with an internal capsule 22 is shown in cross-section in FIG. 5A. An assembled block 80 with an internal capsule 22 generally comprises two block portions 4 with a capsule 22 contained with the space 86 defined by the two block portions 4. In the cross-section of this embodiment, the capsule 22 is comprised of a shell 26 which substantially encompasses a divider 28. FIG. 5B depicts block portions 4 in cross-section to show the relationship of the block face 6, sidewall 8 and rim 10. Upon coupling of the block portions 4, a seam 82 is created by the opposing rims 10. In accordance with the present invention a block having an internal capsule 22 may have the capsule 22 stabilized in the seam 82 by inserting the flange 24 into the seam 82 upon assembly.

Figure 6A:
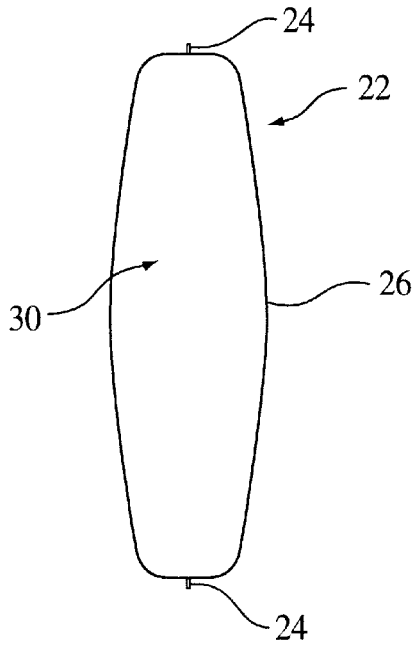
FIG. 6A is a cross-section schematic diagram of a capsule without an interior divider.
Figure 6B:
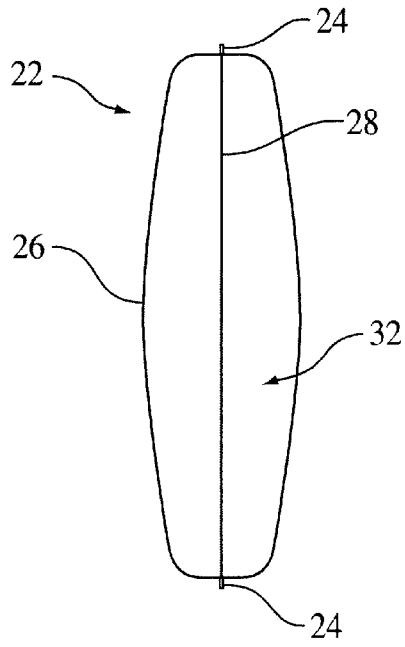
FIG. 6B is a cross-section schematic diagram of a capsule with an interior divider.
Figure 6C:
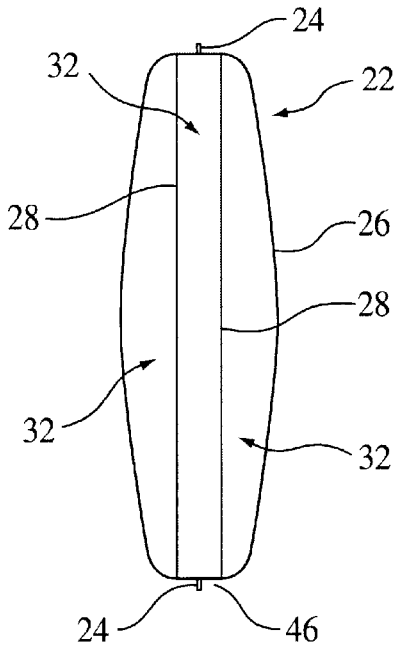
FIG. 6C is a cross-section schematic diagram of a capsule with two interior dividers.

Various possible embodiments of capsules 22 are shown in FIGS. 6A–D. A capsule 22 having a perimeter flange 24 that fits within the seam 82 of the block portions upon assembly, thereby providing a conventional profile of the block sidewall is shown in FIGS. 6A–C.

The capsules 22 can be formed from virtually any material which exhibits the desired balance of physical, aesthetic, mechanical, and chemical properties. Preferably, suitable materials would exhibit ultraviolet stability, high transparency, low haze, and minimal distortion from about −20 degrees F. to about 150 degrees F. For example, a capsule 22 may be formed from polyethylene terephthalate glycol ("PETG"), or any acrylic that exhibits a high degree of transparency, workability, ultraviolet resistance, strength, and cost effectiveness.

Figure 6D:
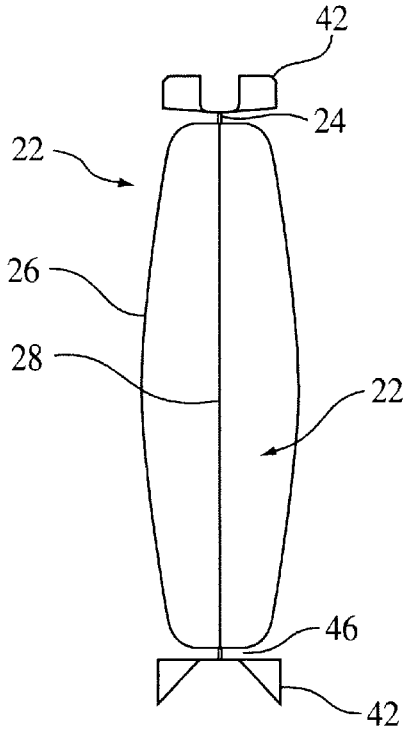
FIG. 6D is a cross-section schematic diagram of a capsule to be substantially contained within a block, having a fitting that protrudes beyond the structural exterior of the block to interact with fittings on adjacent blocks.

Another aspect of the current invention is a thermal capsule 22 which includes a divider 28 as shown in FIGS. 6B–D. The divider 28 may be contained within the exterior shell 26 of the capsule 22 which helps to prevent damage to both the divider 28 and any treatments or coatings on the divider, during assembly.

The divider 28 may contain a variety of treatments, such as treatments to reduce heat transfer through the block, reduce UV light transmission, or adjust to changing environmental stimuli. For example, dividers 28 may contain photo-reactive treatments or devices that respond to changes in ambient light. Additionally, dividers may be coated to increase aesthetic appeal, enhance color features, and otherwise affect the design aspects of the finished product.

The divider 28 is used to segment the chamber 30 of the capsule 22 into sub-units 32, and may be formed from any material that provides the appropriate qualities. For example, a sheet of polyethylene terephthalate-glycol modified plastic ("PETG") would provide transparency, strength and ease of assembly within a shell 26 of PETG. Similarly, a divider 28 may be formed from any material or combination of materials, including but not limited to plastics, such as polyvinyl chloride ("PVC"), recycled polyethylene terephthalate ("RPET"), high impact polystyrene ("HIPS"), or PETG.

In another embodiment, the peripheral flange 24 of the capsule is coupled to a fitting 42 for engaging other blocks with complementary fittings 42 (i.e., FIG. 6D). It will also be recognized by those skilled in the art that fittings 42 can be formed so that upon assembly the fittings 42 act as spacers to help stabilize an assembled panel of finished blocks.

Figure 7B:
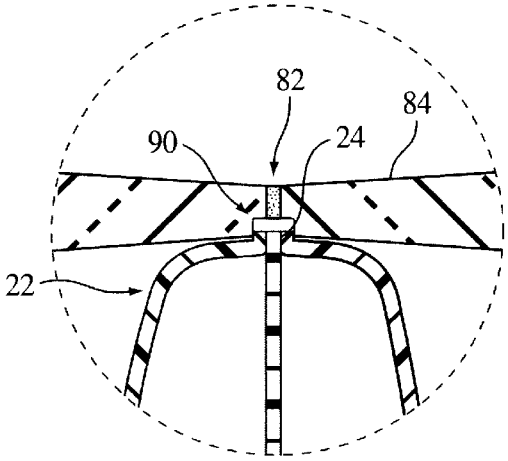
FIG. 7B is an enlarged cross-section schematic diagram of a block seam showing a capsule flange that is contained within a groove of the interior aspect of the rim of the glass block portions.
Figure 7C:
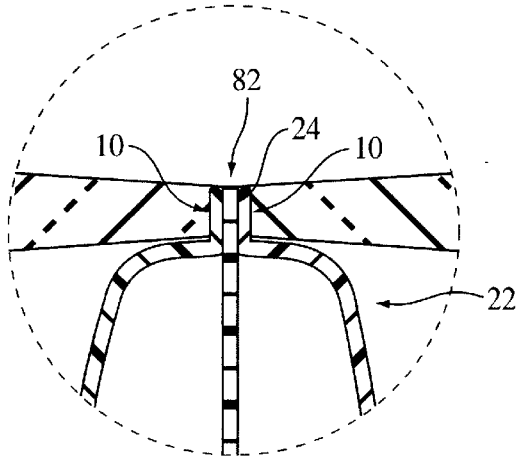
FIG. 7C is an enlarged cross-section schematic diagram of a block seam showing a capsule flange that protrudes substantially through the seam.
Figure 7A:
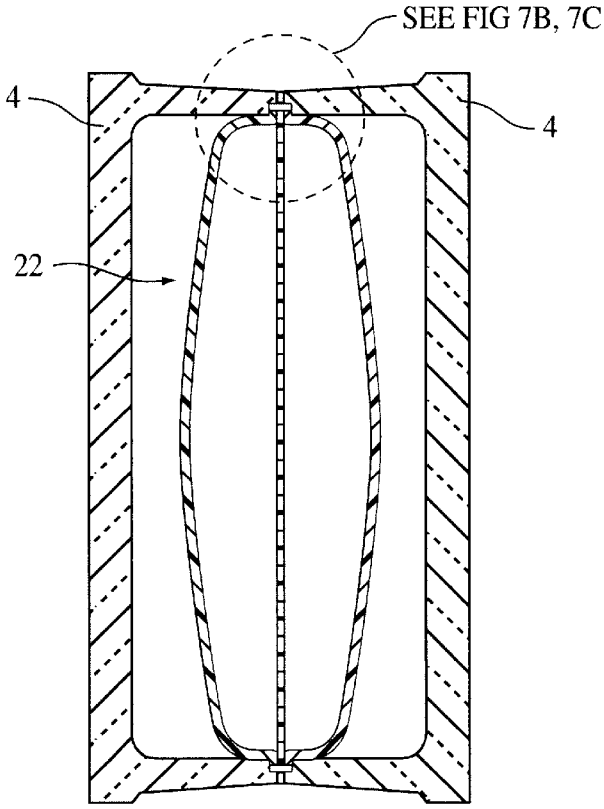
FIG. 7A is a cross-section schematic diagram of a block with an internal capsule.

With reference to FIGS. 7A, 7B and 7C a cross-section and enlargements depicting the relationship between a flange 24 of a capsule 22 and the seam 82 formed by the block portions is shown. In the embodiment shown in FIG. 7B, the flange 24 of the capsule 22 is contained within a groove 90 which is inset into the interior aspect of the rim 10 of the block portion 4. The groove 90 may be pre-formed in the block portions 4 and can be proportionately sized to accept the perimeter flange 24 of a capsule 22.

One advantage of the present invention is to provide one or more spaces 86, chambers 30, and/or cavities 32 within the block 80, as shown in FIG. 5A. One embodiment provides these spaces, chambers and/or cavities without penetration of the sidewall 84, as shown in FIG. 7B. This not only facilitates block assembly but also reduces the risk of seal failures.

In FIG. 7C, the perimeter flange 2 of a capsule 22 is shown protruding through the seam 82 created by the opposing rims 10 of the block portions 4. In FIG. 7C, the flange 24 does not extend beyond the structural exterior of the block. One skilled in the art will recognize, however, that a capsule with fittings 24, such as those shown in FIGS. 1–3, 4A, 6D, and 9 would extend through the seam 82 and beyond the structural exterior of the block. An advantage of a capsule 22 with a flange 24 which protrudes through the seam 82 is that the capsule flange 24 creates a thermal break between the block portions 4. In assembled panels of blocks having fittings 42 coupled to the peripheral flange 24 of the capsule (i.e., FIG. 9), a continuous thermal break is created throughout the joint of the assembled panel 60 due to the contact of the fittings 42. This contact may also constitute a moisture barrier.

Figure 8:
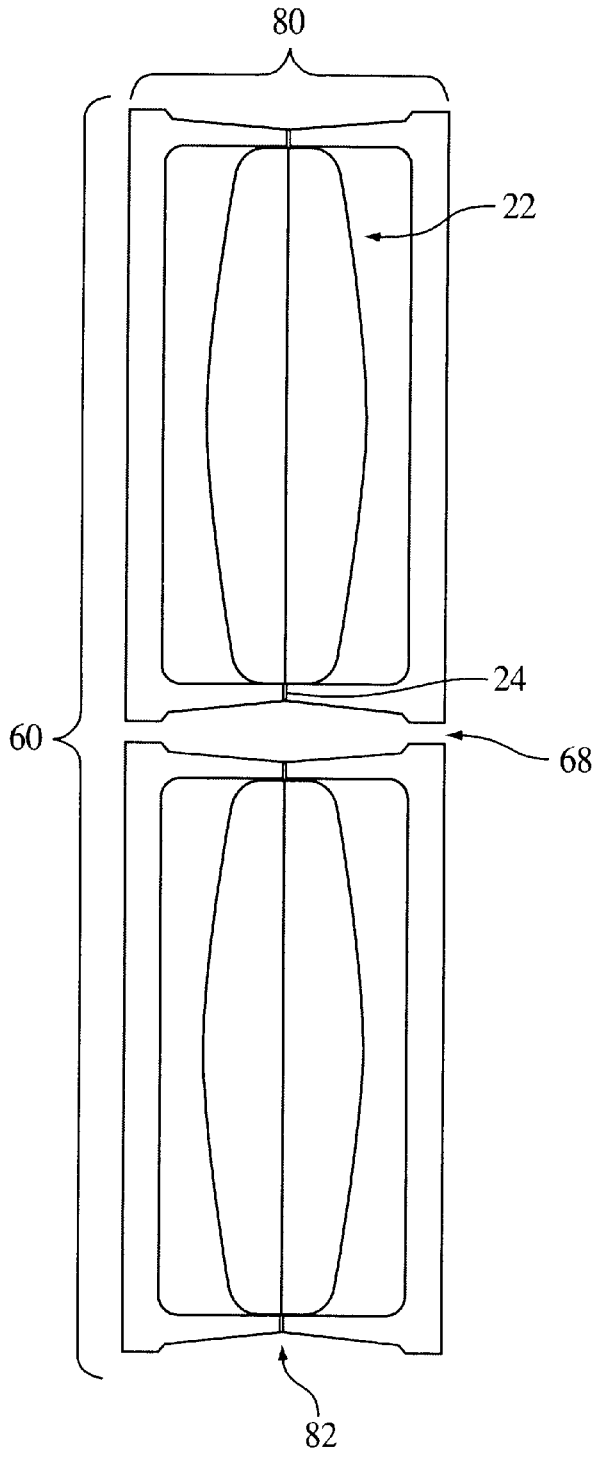
FIG. 8 is a cross-section schematic diagram of a portion of a panel showing two adjacent blocks, each block having an internal capsule.

With reference to FIG. 8, a schematic cross-section portion of a panel of blocks 60 is shown, each block having an internal capsule 22 with a flange 24. Blocks 80 having a conventional sidewall profile as shown in FIG. 8, can be assembled using conventional methods, spacers, mortars, adhesives, frames and/or borders that are known in the art.

Figure 9:
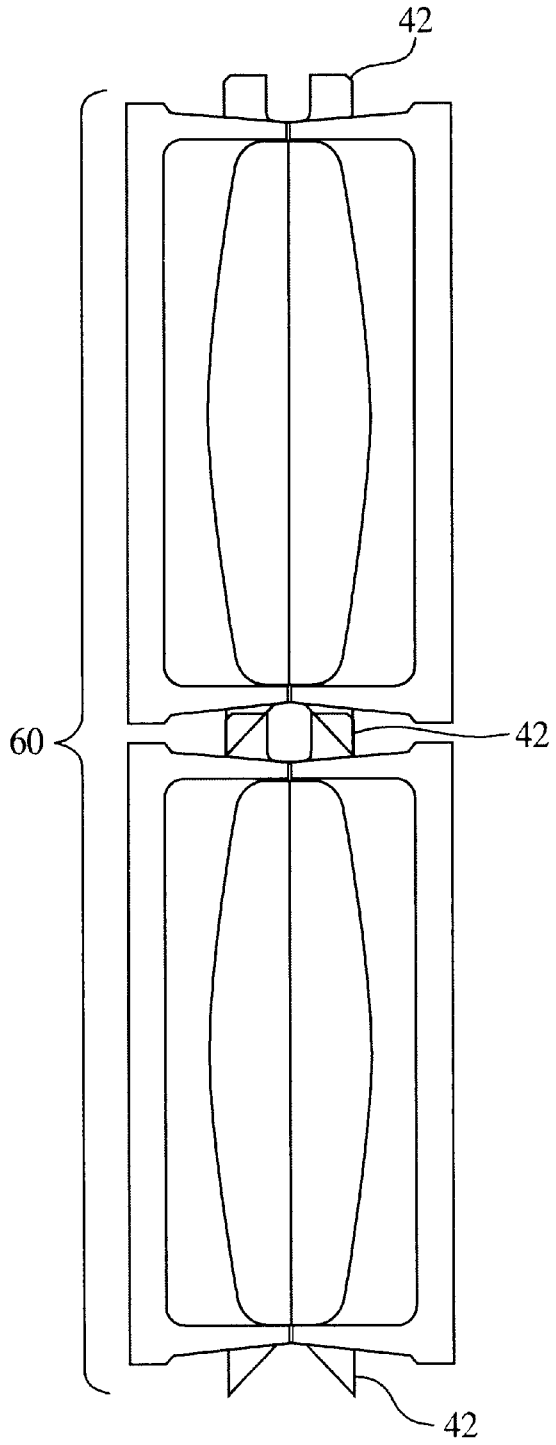
FIG. 9 is a cross-section schematic diagram of a portion of a panel showing blocks with a capsule substantially contained within each block, the capsule having a flange that protrudes through the seam and forms a fitting that interacts with the fitting of an adjacent block.

With reference to FIG. 9, the fitting 42 of the capsule 22 may assist in the rapid and precise assembly and alignment of individual blocks to form panels 60. This assembly can be facilitated by fittings 42 having a traditional male/female relationship, a universal configuration, or some other alignment scheme. It is also contemplated that the fitting 42 may not "connect" with adjacent blocks upon assembly, but may couple with a complementary fitting 42 through mere contact with adjacent fittings, spacers or frames.

The perimeter of a block panel that is formed from individual blocks which have the fittings of the present invention, may relate with a complementary frame or channel. The frame may be designed to contact the perimeter fittings of the assembled panel in the same manner as the individual blocks contact one another. The frame or channel may also include a means for evacuating moisture that may penetrate the joints of the assembled panel.

Traditional panel assembly using blocks requires use of a cementing material which becomes a natural heat-conducting path as well as a pathway for moisture to wick through the panel. One embodiment of the present invention provides a pressure formed thermal capsule 22 with fittings 42 which protrude beyond the periphery of the glass block. These fittings 42 can be in the form of interlocking fittings 42 that connect with adjacent glass blocks and provide for: (1) improved panel assembly and alignment; (2) a nominally spaced joint to accept cement, mortar, or other sealant; (3) a thermal break in the assembled joint to reduce heat loss through the joint; and (4) an internal drainage channel to remove moisture that may penetrate the panel.

The present invention with internal capsules 22 also exhibits increased resistance to projectile penetration, due in part to the increase in the number of layers of material 26, 28 that are present. In addition to simply providing additional layers 26, 28 through which a projectile must pass, the chambers 30 and cavities 32 of the capsule 22 act like a cushion. Further, the chambers 30 and cavities 32 of the capsule 22 and/or the interior spaces 86 between the exterior shell 26 and the block portions 4, may also be pressurized and/or filled with some phase of matter (e.g., gas, gel, liquid or solid) to affect their resistance to penetration. These same features and structures may also be employed to improve the sound-dampening qualities of the present invention.

While specific embodiments and methods for practicing this invention have been described in detail, those skilled in the art will recognize various manifestations and details that could be developed in light of the overall teachings herein. Accordingly, the particular arrangements disclosed are meant to be illustrative only and not to limit the scope of the invention which is to be given the full breadth of the following claims and any and all embodiments thereof.

What is claimed is:

1. A block comprising:

a first glass portion and a second glass portion, wherein said portions are coupled to form an interior space; and, a capsule substantially disposed within the interior space, said capsule having a channel into which at least one of the glass portions is placed for coupling.

2. The block of claim 1 wherein said capsule includes a flange that is disposed at least partially between the first and second glass portions and that provides a thermal break between the first and second glass portions.

3. The block of claim 1, wherein said capsule includes a fitting for coupling to a complementary fitting.

4. The block of claim 1 wherein said capsule further comprises a block portion positioning means.

5. A panel comprising a plurality of blocks, wherein at least one block has an interior space with a capsule substantially disposed within the interior space, said capsule having a channel into which at least one glass portion of said block is placed for coupling.

6. The panel of claim 5 wherein the capsule includes a fitting, for coupling toga corresponding fitting associated with an adjacent block.

7. A method of assembling a block with a capsule having a channel into which at least one of the glass portions is placed for coupling comprising the steps of:

placing a sealant into said channel;

placing a first glass block portion into the channel to contact said sealant; and, placing a second glass block portion opposite said first glass block portion.

8. The method of claim 7 further comprising the step of trimming the channel after the sealant has cured.

9. A method of making a glass block to comply with hurricane resistance standards, comprising the steps of:

preparing a first glass portion and a second glass portion that are coupled to form an interior space; and, assembling the glass portions with a capsule substantially disposed within the interior space, said capsule having a channel into which at least one of the glass portions is planed for coupling.

10. The block of claim 1 wherein said capsule is made substantially from a material selected from the group consisting of of acrylic, PVC, RPET, PETG and HIPS.

11. The block of claim 1 wherein said capsule includes a divider substantially disposed, within said capsule.

* * * * *